US011401078B2

(12) United States Patent
Graux

(10) Patent No.: US 11,401,078 B2
(45) Date of Patent: Aug. 2, 2022

(54) TETHERED PLASTIC SCREW STOPPER

(71) Applicant: NOVEMBAL USA INC., Edison, NJ (US)

(72) Inventor: Stéphane Graux, Liergues (FR)

(73) Assignee: Novembal USA Inc., Edison, NJ (US)

( * ) Notice: Subject to any disclaimer, the term of this patent is extended or adjusted under 35 U.S.C. 154(b) by 0 days.

(21) Appl. No.: 17/290,944

(22) PCT Filed: Nov. 4, 2019

(86) PCT No.: PCT/US2019/059705
§ 371 (c)(1),
(2) Date: May 3, 2021

(87) PCT Pub. No.: WO2020/093058
PCT Pub. Date: May 7, 2020

(65) Prior Publication Data

US 2021/0371168 A1 Dec. 2, 2021

Related U.S. Application Data

(60) Provisional application No. 62/755,499, filed on Nov. 4, 2018.

(51) Int. Cl.
*B65D 41/34* (2006.01)
*B65D 55/16* (2006.01)

(52) U.S. Cl.
CPC ..... *B65D 41/3409* (2013.01); *B65D 55/16* (2013.01)

(58) Field of Classification Search
CPC ..... B65D 41/3409; B65D 55/16; B65D 2401/30; B65D 41/3428; B65D 2401/40
See application file for complete search history.

(56) References Cited

U.S. PATENT DOCUMENTS

| | | | |
|---|---|---|---|
| 4,394,918 | A | 7/1983 | Grussen |
| 4,546,892 | A | 10/1985 | Couput |
| 4,546,893 | A | 10/1985 | Stull |
| 4,565,293 | A | 1/1986 | Jonas |
| 4,805,792 | A | 2/1989 | Lecinski, Jr. |
| 6,308,848 | B1 | 10/2001 | Parrinello |
| 6,464,093 | B1 | 10/2002 | Takano |
| 2006/0091100 | A1 | 5/2006 | Geho |

(Continued)

OTHER PUBLICATIONS

International search report dated Jan. 2, 2020.

*Primary Examiner* — Shawn M Braden

(57) ABSTRACT

The present invention relates to tethered plastic stopper having a closure shell, a tamper band, and an annular ring. The annular ring is formed between a bottom weakness line separably linked through bottom bridges to the top edge of the tamper band and to the bottom edge of the annular ring and a top weakness line separably linked through top bridges to the top edge of the annular ring and to the bottom edge of the closure shell. At least one of the bottom bridges is configured to prevent disconnection of the annular ring from the tamper band and at least one of the top bridges is configured to prevent disconnection of the annular ring from the closure shell. The remaining bottom bridge and the remaining top bridge having a section exceeding at least 30% relative to the section of the bottom bridges and top bridges, respectively.

16 Claims, 4 Drawing Sheets

(56) References Cited

U.S. PATENT DOCUMENTS

| | | | | |
|---|---|---|---|---|
| 2010/0326948 | A1* | 12/2010 | Campbell | B65D 41/34<br>215/252 |
| 2019/0344944 | A1* | 11/2019 | Maguire | B65D 41/04 |
| 2019/0375557 | A1* | 12/2019 | Lutton | B65D 41/3428 |
| 2021/0323739 | A1* | 10/2021 | Lamoureux | B65D 55/16 |

* cited by examiner

TETHERED PLASTIC SCREW STOPPER

TECHNICAL FIELD

This invention relates to a tethered plastic screw stopper.

BACKGROUND

In the field of liquid packaging, it is very common to seal the aperture of a container with a stopper, often made from a plastic material. Such container is usually a plastic or glass bottle, but other materials may be used as well.

The stopper has a tubular shape closed at its top edge by a top wall. The stopper comprises a roof attached to a tamper shell through bridges. Bridges are distributed around the circumference of the roof and the tamper shall. The bridges may be made when molding the stopper or after through undergoing a cutting step during the manufacturing process.

Usually the bottle neck includes outer fixation feature, such as thread(s) for screw type stopper or annular fixation rings for snap type stopper, to secure the stopper on the bottle neck.

For screw type stoppers, the tamper shell comprises inner thread(s) arranged inside side walls. The bottle neck fixation feature may include outer thread(s). Such combination of outer and inner thread(s) allows the stopper to be screwed on a bottle neck to seal it and unscrewed for bottle opening. A snap type stopper may include an inner annular area and the bottle neck fixation feature may include outer fixation ring, in order to slot in force the stopper on the bottle neck. A snap type stopper may include a tamper shell with a movable sealing roof from a closed position to a partial opening position, and reversely. The roof may be separated upon opening or may be connected to the tamper shell.

In a bottle sealing position of the stopper, the tamper shell may be secured around the bottle neck through inner shell retaining features or through the retaining features diameter is smaller than a diameter of a tamper shell of the bottle neck.

The roof may be removable. During bottle opening, the bridges form a weakness line and may be torn apart from the roof, separating it from the bottle. The weakness line may be torn when user unscrews the tamper shell of the stopper or when user lifts the roof by tilting.

There is a recycling risk with separable roof as consumers may not always screw or snap back the roof onto the bottle neck once empty. The stopper may be thrown away as litter or put into the trash bin, or worse make its way into a landfill, which is not good in view of the environmental considerations.

One solution includes linking the roof to the tamper shell secured on the bottle neck, so the roof stays attached to the bottle after bottle opening. Such an attached stopper may be called a "tethered stopper."

U.S. Pat. No. 9,010,555 teaches a plastic screw stopper including a peripheral strip between a tamper shell and a roof. Such peripheral strip is linked to the tamper shell through a bottom weakness line and to the roof through a top weakness line. The bottom weakness line and top weakness line are parallel and extend across the periphery of the stopper in order to incorporate one or two hinges in close proximity to each other. When unscrewing the stopper the bottom weakness line and top weakness line tear apart, but the two hinges hold the roof on the tamper shell. The roof becomes unmovable and as capable of toggling around the hinges beside of the stopper secured on the bottle neck.

U.S. Pat. No. 8,490,805 teaches a plastic screw stopper comprises a helicoidal strip between a tamper shell and a roof. Such helicoidal strip is obtained by cutting the tamper shell around the stopper. The outer wall of the tamper shell is placed against a blade and the stopper is moved in rotation relative to the blade according to an angular stroke greater than an entire turn or more than 360°. During rotation, the stopper is moved in an axial movement relative to the blade. The cut line forms a helicoidal weakness line which remains attached at one end to the tamper shell and at its opposite end to the roof after opening.

Other known art prior art systems include a tethered stopper comprising a spiral strip. The spiral strip is made during the stopper molding so there is no cutting or slitting operations. Other known prior art systems includes tethered stoppers comprising two strips linking the closure shell to the tamper band secured on the bottle.

SUMMARY

This invention is a tethered plastic screw stopper where its closure shell remains attached to its tamper band after bottle opening through an annular ring made into the plastic material of the tamper band or the closure shell and made around the stopper. The annular ring is separably linked at its bottom edge to the tamper band through bottom bridges and at its top edge to the closure shell through top bridges, where one of the bottom bridges and one of the top bridges is thick enough in order not to be broken when opening the stopper. The section of the remaining bottom bridge and of the remaining top bridge may exceed at least 30% relative to the section of the other bridges.

When opening the stopper by unscrewing the closure shell, a force applied on the bridges is sufficient to tear and to break the bridges, due to their less important sections, but the force is typically not sufficient to break the remaining bottom and top bridges due to their larger section because the remaining bridges are typically stronger.

The tethered stopper can have an annular ring that is maintained by the bridges. The conception and the fabrication of the stopper is typically easier and less expensive.

DETAILED DESCRIPTION OF THE DRAWINGS

The figures are not necessarily to scale and some features may be exaggerated or minimized, such as to show details of particular components. Emphasis is placed on illustrating the principles of the invention. In the figures, like reference numerals designate corresponding parts throughout the different views.

DETAILED DESCRIPTION

Figure 1:
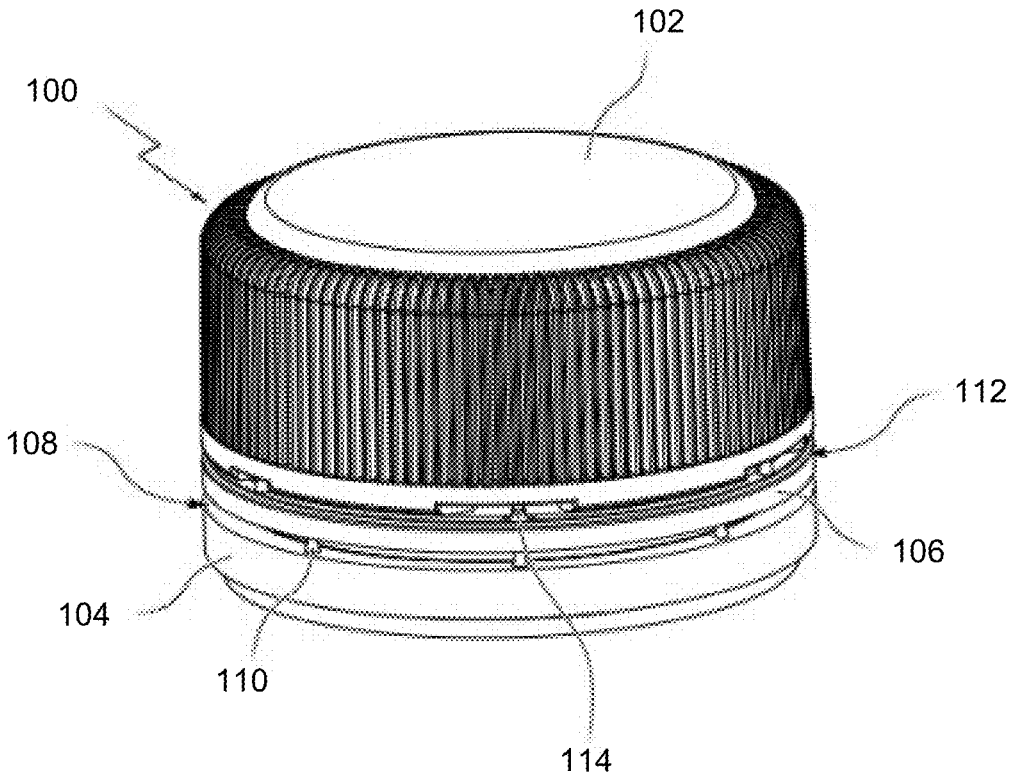
FIG. 1 is a perspective view of a tethered stopper.
Figure 2:
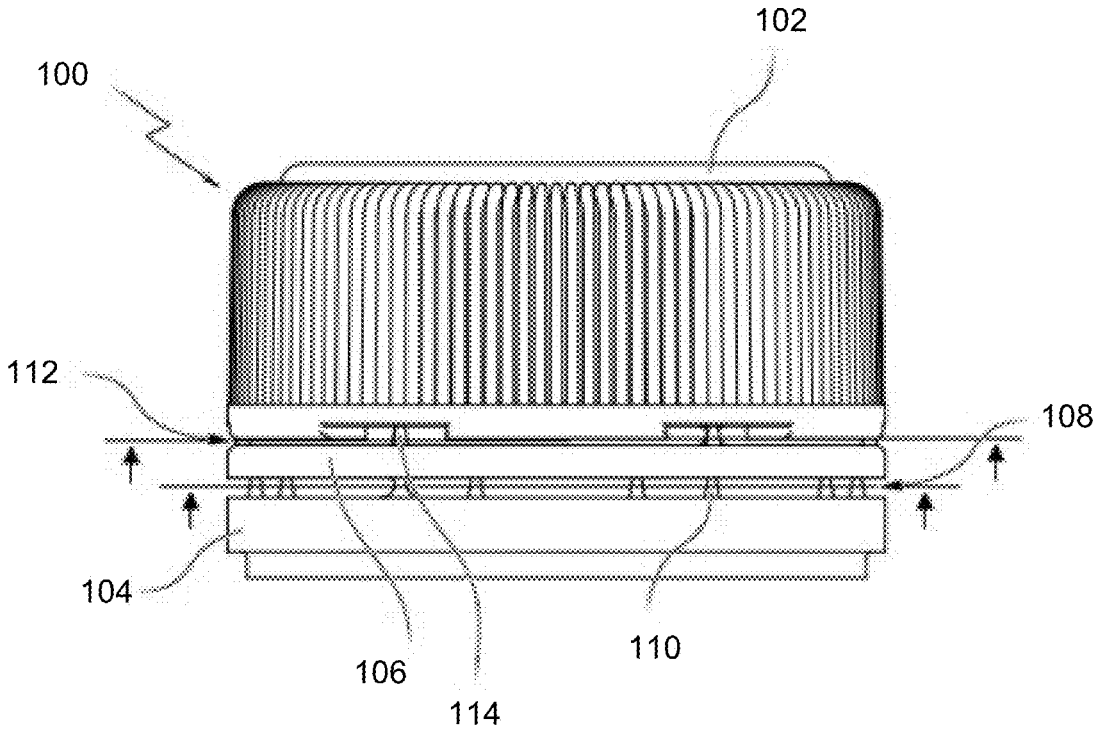
FIG. 2 is a side view of the tethered stopper.

As required, detailed embodiments of the present disclosure are disclosed herein. The disclosed embodiments are merely examples that may be embodied in various and alternative forms, and combinations thereof. As used herein, for example, exemplary, and similar terms, refer expansively to embodiments that serve as an illustration, specimen, model or pattern.

In some instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Phrasing such as 'configured to' perform a function, including in the claims, can include any or all of being sized, shaped, positioned in the arrangement, and comprising material to perform the function.

Terms indicating quantity, such as 'first' or 'second' are used for exemplary and explanation purposes and are not intended to dictate the specific ordering of a component with respect to other components. Terms indicating position such as 'top' or 'bottom' and 'left' or right' are used for exemplary and explanation purposes with respect to other components.

Various embodiments of the present disclosure are disclosed herein. The described embodiments are merely exemplary illustrations of implementations set for a clear understanding of the principles of the disclosure. Variations, modifications, and combinations may be made to the described embodiments without departing from the scope of the claims. All such variations, modifications, and combinations are included herein by the scope of this disclosure and the claims.

The invention relates to a tethered plastic screw stopper 100, for closing a bottle neck. The stopper 100 is integrally made of one plastic piece by a molding fabrication step. Other parts or elements of the stopper 100 can be further created into the entire plastic piece through a cutting or slitting step.

The stopper 100 is a screw type and comprises inner fixation features, such as thread(s), designed to cooperate with outer complementary fixation features made on the bottle neck. The stopper 100 comprises a closure shell 102 and underneath a tamper band 104. The tamper band 104 and the closure shell 102 are linked together through an annular ring 106.

The annular ring 106 is managed into the closure shell 102 or the tamper band 104 when molding or through a cutting operation. In other words, the annular ring 106 can be formed into the plastic material of the closure shell 102 or of the tamper band 104. The annular ring 106 is made when molding the stopper 100 or through a subsequent cutting operation.

At its bottom edge, the tamper band 104 comprises retaining features that secure the stopper 100 when sealing the bottle. The retaining features are made of a collar. After the collar is inverted inside the tamper band 104, in bottle sealing the collar locks the tamper band 104 and the entire stopper 100 against a tamper evident ring managed outwardly around the bottle neck. The retaining features can also be molded directly from the injection process resulting in beads that do not need to be inverted like the collar.

The stopper 100 comprises a bottom weakness line 108 between the tamper band 104 and the annular ring 106. The bottom weakness line 108 is made of bottom bridges 110. The bottom bridges 110 may be distributed along the bottom weakness line 108, having a regular or irregular spacing between the bridges 110. The bottom bridges 110 link the top edge of the tamper band 104 to the bottom edge of the annular ring 106.

The stopper 100 also comprises a top weakness line 112 between the closure shell 102 and the annular ring 106. The top weakness line 112 is made of top bridges 114. The top bridges 114 may be distributed along the top weakness line 112, having a regular or irregular spacing between the bridges 114. The top bridges 114 link the bottom edge of the closure shell 102 to the top edge of the annular ring 106.

The bottom weakness line 108 and the top weakness line 112 separably link the closure shell 102 and the tamper band 104, through the annular ring 106. Thus, when unscrewing the closure shell 102, the bottom bridges 110 and the top bridges 114 are torn apart until they break. The closure shell 102 can be manually removed by the consumer, in order to open the bottle and have access to the bottle's contents.

The stopper 100 is tethered so that when opened, the closure shell 102 stays attached to the tamper band 104 secured on the bottle neck through its retaining features while the annular ring 106 remains attached to the closure shell 102 and the tamper band 104. Therefore, one of the bottom bridges 110 is a remaining bottom bridge 400 and one of the top bridges 114 is a remaining top bridge 300. Thus, all of the bottom bridges 110 and all top bridges 114 are torn apart and broken, with the exception of at least one remaining bridge on the top weakness line 112 and at least one remaining bridge on the bottom weakness line 108.

The remaining top bridge 300 and/or the remaining bottom bridge 400 have a greater thickness and/or cross-sectional area relative to the other breakable bridges 110, 114 on the respective weakness lines 110, 112. For example, the remaining bottom bridge 400 and the remaining top bridge 300 having a section (e.g., cross-sectional area) exceeding at least 30% relative to the section of the bottom bridges 110 and/or the top bridges 114.

The greater sections of the remaining bottom bridge 400 and of the remaining top bridge 300 are sufficiently thick as to not break when unscrewing the closure shell 102, when the other bottom bridges 110 and top bridges 114 are broken. According to one of the embodiments, the remaining bottom bridge 400 and the remaining top bridge 300 have a section at least 150% of the section of the bottom bridges 110 and/or top bridges 114. The remaining bottom bridge 400 and the remaining top bridge 300 have a 200% section compared to the section of the bottom bridges 110 and/or top bridges 114.

Figure 3:
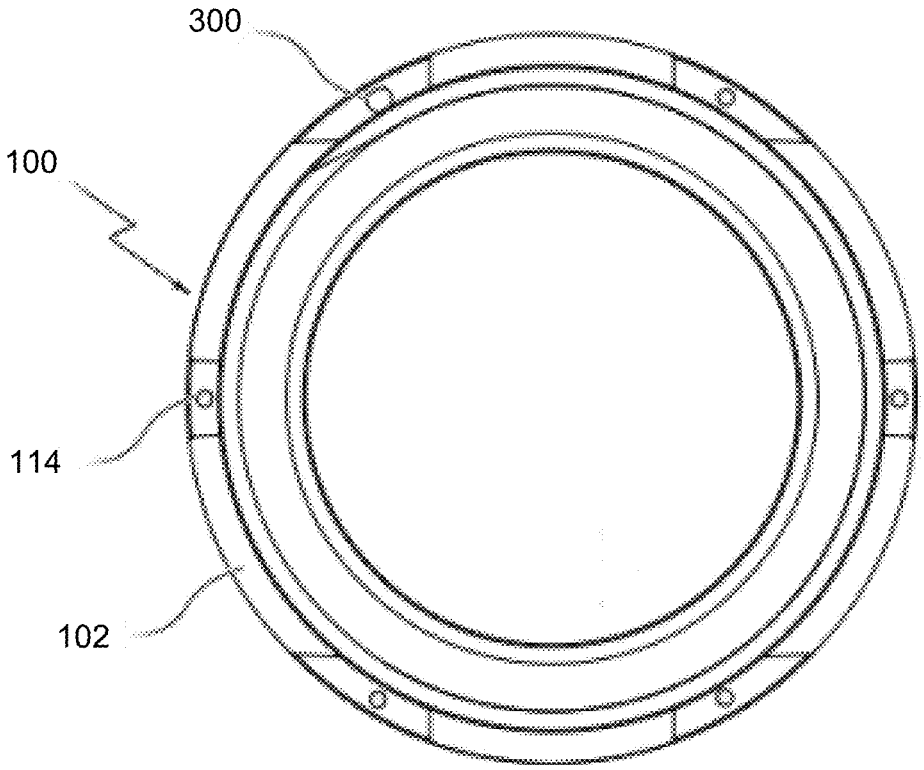
FIG. 3 is a cross-sectional view along a top section plan of FIG. 2.
Figure 4:
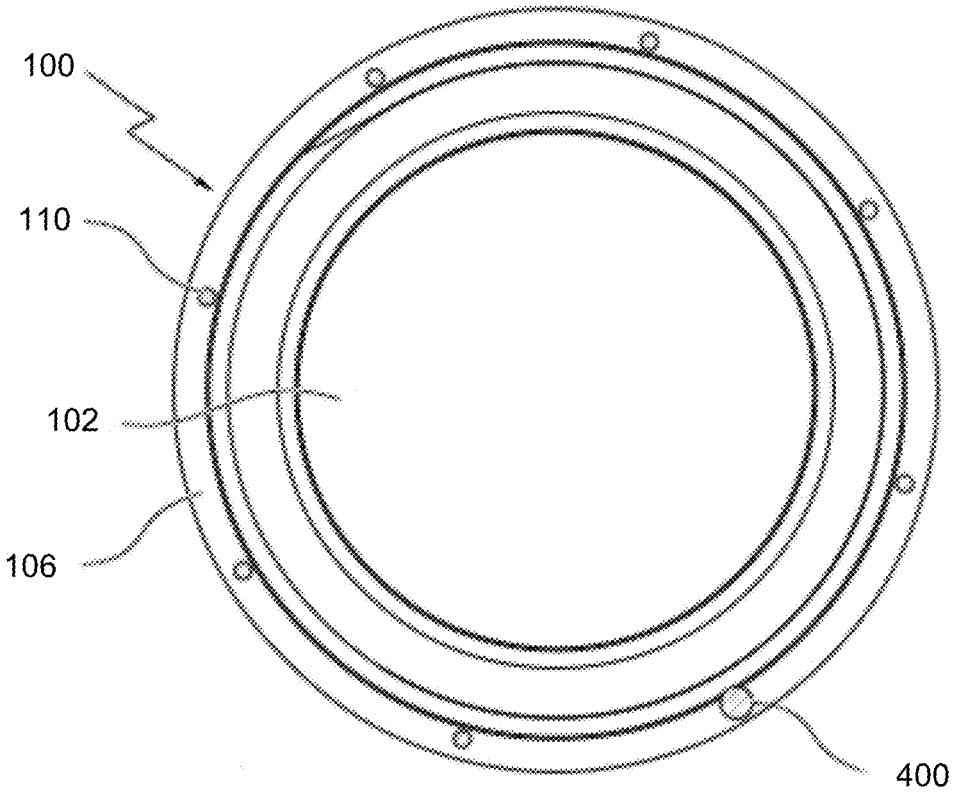
FIG. 4 is a cross-sectional view along a bottom section plan of FIG. 2.

As an example, shown in FIGS. 3 and 4, the remaining bottom bridge 116 and the remaining top bridge 300 have a cylindrical or conical shape. Thus, their section of the remaining bottom bridge 400 and the section of the remaining top bridge 300 have a diameter exceeding at least 30% relative to the diameter of the bottom bridges 110 and/or of the top bridges 114.

In another embodiment, the remaining bottom bridge 400 and the remaining top bridge 300 have a square or rectangular shape. Thus, their section has a length and/or a width exceeding at least 30% relative to the length and/or width of the bottom bridges 110 and of the top bridges 114. The invention, the difference of dimension of the section of the remaining bridges is compared to one or several other "usual" bridges. The section difference can be average, regarding fabrication variation of the section of "usual" bridges.

In some embodiments, as shown in FIGS. 3 and 4, the remaining top bridge 300 is diametrically located at the opposite of the remaining bottom bridge 400. Thus, after opening the annular ring 106 can be twisted around the remaining bottom bridge 400 to move or position the closure shell 102 away from the bottle neck, not bothering the consumer when drinking.

Not shown in the figures, a second bottom bridge and a second top bridge can have a thickness exceeding at least 30% relative to the thickness of the bottom and/or top bridges. Another remaining bottom bridge may be positioned near the remaining bottom bridge 400, and the other remaining top bridge positioned near the remaining top bridge 300. In other words, several remaining bridges close to each other can be managed at the top and at the bottom, with a greater section than the other bridges. So, the resistance of the remaining bridges is greater in order not to be broken when unscrewing the closure shell 102.

While various embodiments of the invention have been described, it will be apparent to those of ordinary skill in the art that many more embodiments and implementations are possible that are within the scope of this invention.

What is claimed is:

1. A tethered plastic screw stopper, comprising:

a closure shell and a tamper band; and an annular ring formed between:

a bottom weakness line separably linked through molded bottom bridges to a top edge of the tamper band and to a bottom edge of the annular ring; and a top weakness line separably linked through molded top bridges to a top edge of the annular ring and to a bottom edge of the closure shell, wherein:

at least one of the bottom bridges is a remaining bottom bridge molded and configured to prevent disconnection of the annular ring from the tamper band;

at least one of the top bridges is a remaining top bridge molded and configured to prevent disconnection of the annular ring from the closure shell; and the remaining bottom bridge having a cross-sectional area that is at least 30% greater than the cross-sectional area of the bottom bridges and the remaining top bridge having a cross-sectional area that is at least 30% greater than the cross-sectional area of the top bridges.

2. Tethered plastic screw stopper according to claim 1, wherein the remaining bottom bridge and/or the remaining top bridge have a square or rectangular cross-section, the cross-section having a length and/or a width that is at least 30% greater than the bottom and top bridge length and/or width.

3. Tethered plastic screw stopper according to claim 1, wherein the remaining bottom bridge and the top remaining bridge have a cylindrical or conical cross-section, the cross-section having a diameter that is at least 30% greater than the bottom and top bridge diameter.

4. Tethered plastic screw stopper according to claim 1, wherein the remaining top bridge is diametrically opposite of the remaining bottom bridge.

5. Tethered plastic screw stopper according to claim 1, wherein the annular ring is formed into the closure shell or tamper band when molding.

6. Tethered plastic screw stopper according to claim 1, wherein:

at least another of the bottom bridges is another remaining bottom bridge;

at least another of the top bridges is another remaining top bridge;

the another remaining bottom bridge having a cross-sectional area that is at least 30% greater than the cross-sectional area of the bottom bridges and the another remaining top bridge having a cross-sectional area that is at least 30% greater than the cross-sectional area of the top bridges; and the another remaining bottom bridge is located near the remaining bottom bridge, and the another remaining top bridge is located near the remaining top bridge.

7. Tethered plastic screw stopper according to claim 6, wherein the remaining top bridges are diametrically opposite of the remaining bottom bridges.

8. Tethered plastic screw stopper according to claim 1, wherein at least another of the bottom bridges is another remaining bottom bridge;

the another remaining bottom bridge having a cross-sectional area that is at least 30% greater than the cross-sectional area of the bottom bridges; and the another remaining bottom bridge is located near the remaining bottom bridge.

9. Tethered plastic screw stopper according to claim 1, wherein at least another of the top bridges is another remaining top bridge;

the another remaining top bridge having a cross-sectional area that is at least 30% greater than the cross-sectional area of the top bridges; and the another remaining top bridge is located near the remaining top bridge.

10. A tethered plastic screw stopper, comprising:

a closure shell and a tamper band; and an annular ring formed between:

a bottom weakness line separably linked through bottom bridges to a top edge of the tamper band and to a bottom edge of the annular ring; and a top weakness line separably linked through top bridges to a top edge of the annular ring and to a bottom edge of the closure shell, wherein:

at least one of the bottom bridges is a remaining bottom bridge configured to prevent disconnection of the annular ring from the tamper band;

at least one of the top bridges is a remaining top bridge configured to prevent disconnection of the annular ring from the closure shell; and the remaining bottom bridge having a cross-sectional diameter that is more than 30% of the cross-sectional diameter of the bottom bridges and the remaining top bridge having a cross-sectional diameter that is more than 30% of the cross-sectional diameter of the top bridges.

11. Tethered plastic screw stopper according to claim 10, wherein the remaining top bridge is diametrically opposite of the remaining bottom bridge.

12. Tethered plastic screw stopper according to claim 10, wherein the remaining top bridges are diametrically opposite of the remaining bottom bridges.

13. Tethered plastic screw stopper according to claim 10, wherein at least another of the bottom bridges is another remaining bottom bridge;

the another remaining bottom bridge having a cross-sectional area that is at least 30% greater than the cross-sectional area of the bottom bridges; and the another remaining bottom bridge is located near the remaining bottom bridge.

14. Tethered plastic screw stopper according to claim 10, wherein at least another of the top bridges is another remaining top bridge;

the another remaining top bridge having a cross-sectional area that is at least 30% greater than the cross-sectional area of the top bridges; and the another remaining top bridge is located near the remaining top bridge.

15. Tethered plastic screw stopper according to claim 10, wherein at least another of the bottom bridges is another remaining bottom bridge;

at least another of the top bridges is another remaining top bridge;

the another remaining bottom bridge having a cross-sectional diameter that is at least 30% greater than the cross-sectional diameter of the bottom bridges and the another remaining top bridge having a cross-sectional diameter that is at least 30% greater than the cross-sectional diameter of the top bridges; and the another remaining bottom bridge is located near the remaining bottom bridge, and the another remaining top bridge is located near the remaining top bridge.

16. Tethered plastic screw stopper according to claim 15, wherein the remaining top bridges are diametrically opposite of the remaining bottom bridges.

* * * * *